US006814165B2

(12) United States Patent
Schauerte

(10) Patent No.: US 6,814,165 B2
(45) Date of Patent: Nov. 9, 2004

(54) HARD ROCK DRILLING DEVICE AND METHOD

(75) Inventor: Manfred Schauerte, Schmallenberg (DE)

(73) Assignee: Tracto-Technik GmbH, Lennestadt (DE)

( * ) Notice: Subject to any disclaimer, the term of this patent is extended or adjusted under 35 U.S.C. 154(b) by 5 days.

(21) Appl. No.: 10/182,481

(22) PCT Filed: Jan. 23, 2001

(86) PCT No.: PCT/EP01/00693

§ 371 (c)(1),
(2), (4) Date: Dec. 11, 2002

(87) PCT Pub. No.: WO01/57353

PCT Pub. Date: Aug. 9, 2001

(65) Prior Publication Data

US 2003/0132031 A1 Jul. 17, 2003

(30) Foreign Application Priority Data

Feb. 1, 2000 (DE) ..... 100 04 217

(51) Int. Cl.[7] ..... E21B 7/00

(52) U.S. Cl. ..... 175/57; 175/92; 175/296; 175/320

(58) Field of Search ..... 175/57, 67, 92–107, 175/296, 322, 320

(56) References Cited

U.S. PATENT DOCUMENTS

| | | | | | |
|---|---|---|---|---|---|
| 1,390,025 | A | * | 9/1921 | Drake | 175/97 |
| 2,320,550 | A | * | 6/1943 | Allen | 175/318 |
| 2,728,556 | A | * | 12/1955 | House | 175/322 |
| 2,754,086 | A | * | 7/1956 | Summers | 175/322 |
| 3,534,822 | A | | 10/1970 | Keine | |
| 3,860,019 | A | * | 1/1975 | Teague | 134/109 |
| 4,534,427 | A | * | 8/1985 | Wang et al. | 175/67 |
| 4,958,691 | A | * | 9/1990 | Hipp | 175/296 |
| 5,327,980 | A | | 7/1994 | Smet | |
| 5,431,237 | A | * | 7/1995 | Wittliff | 175/72 |
| 6,003,606 | A | * | 12/1999 | Moore et al. | 166/381 |
| 6,129,160 | A | * | 10/2000 | Williams et al. | 175/107 |

FOREIGN PATENT DOCUMENTS

| | | |
|---|---|---|
| DE | 1 025 360 | 8/1951 |
| DE | 1 702 901 | 6/1955 |
| DE | 39 19 719 | 1/1991 |
| EP | 0 710 764 B1 | 8/1996 |
| EP | 0 787 886 B1 | 8/1997 |
| FR | 2101113 A | 3/1972 |
| JP | 06141430 | 8/1994 |
| WO | PCT/EP01/00693 | 8/2001 |
| WO | PCT/EP01/00693 | 11/2001 |

* cited by examiner

*Primary Examiner*—Hoang Dang
(74) *Attorney, Agent, or Firm*—Cook, Alex, McFarron, Manzo, Cummings & Mehler, Ltd.

(57) ABSTRACT

Method and apparatus for underground drilling and enlarging of holes, in particular in hard rock, by using a water-driven motor as drive unit.

12 Claims, 1 Drawing Sheet

HARD ROCK DRILLING DEVICE AND METHOD

Figure 1:
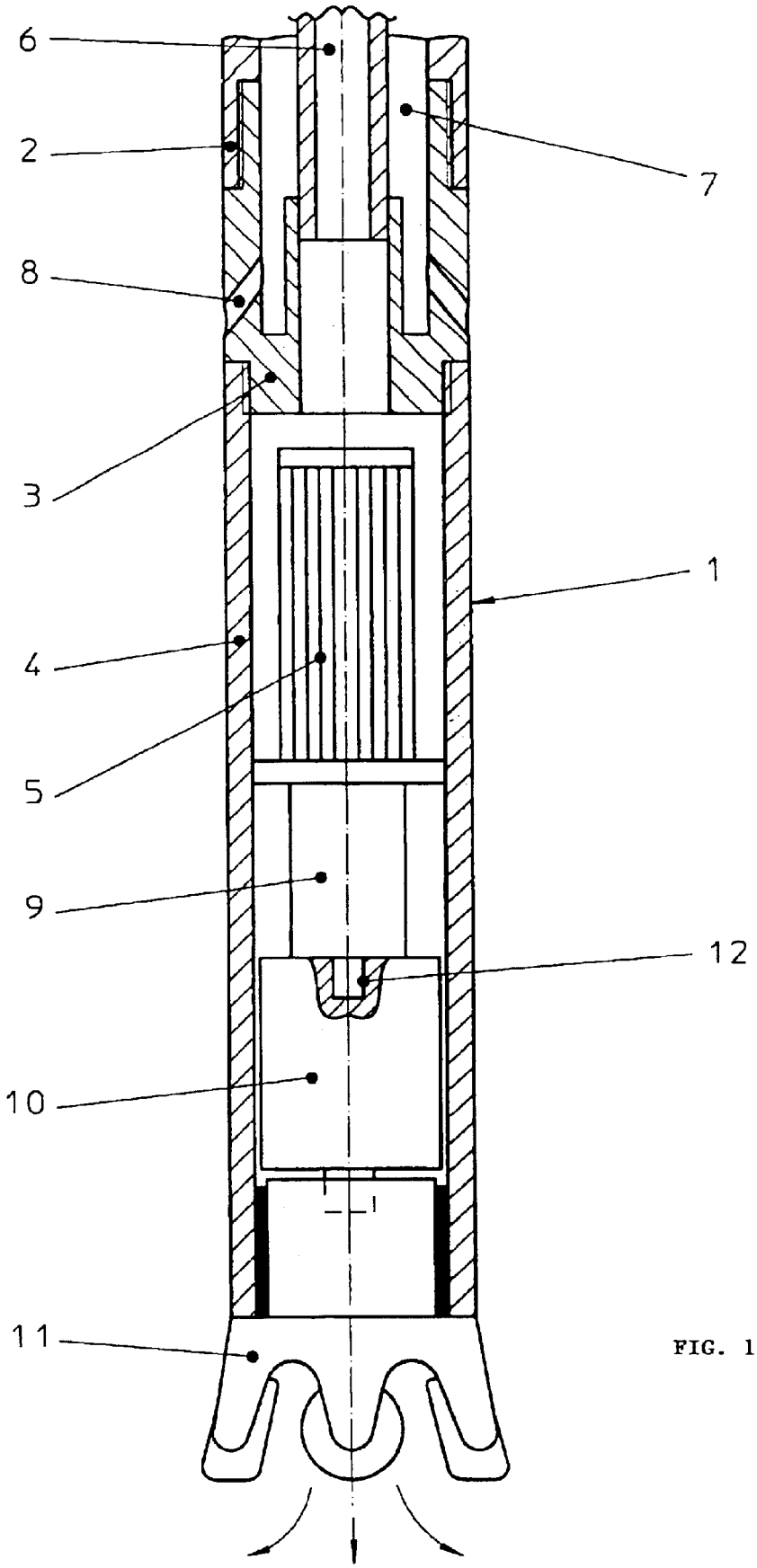

This application is a 371 of PCT/EP01/00639, filed Jan. 23, 2001, which claims the priority of the German patent application 100 04 217.1, filed Feb. 01, 2000.

Drilling holes in hard rock makes particular demands of the drilling apparatus used, in particular of the drive motor. In order to be able to break sediments from a hard rock formation, the bore head, for example a rock milling head, requires a specific torque and a specific cutting speed that is obtained from the rotational speed of the bore head and the rate of feed of the drilling laffette. In this case, the cutting speed drops off with increasing hardness of the rock, while the rotational speed and the torque increase.

Bore heads for underground drilling of holes in hard rocks are normally operated by so-called mud motors that work using the principle of displacement-action screw motors. This type of drive for underground drilling installations is described, for example, in European laid-open patent specifications 0 710 764 and 0 787 886.

The conventional mud motors are designed as screw motors having a threaded stator and rotor, likewise threaded, rotating therein. The two threads have different numbers of threads per unit length, those of the rotor always being greater than those of the stator.

If bentonite is pumped into the drilling motor, it fills the space between the rotor and the stator and gets the rotor rotating. Since the rotor executes an eccentric movement in the stator, its rotary movement must be guided to the bearing spindle of the bore head via a universal driveshaft.

The motors working according to this screw principle tolerate only a slight pressure difference. In order, nevertheless, to produce the required power, that is to say to generate the required pressure difference that is to be converted into energy, the rotors and stators must have a substantial length. Lengths of 3 to 8 meters are not unusual in this case. In addition to a high cost outlay on materials, this entails the great disadvantage of difficult handling of the apparatus at building sites and in small drill holes.

A further possibility of increasing the pressure difference of the screw motors consists in the use of large quantities of bentonite. It is usual in this case to require quantities of bentonite of the order of magnitude of 150 to 600 l/min. Other viscose media are also used.

The use, in particular, of bentonite presupposes the presence of bentonite mixing plants, since the mixture of the bentonite must be adapted to the concrete nature of the ground or rock. In addition, out of ecological considerations, the bentonite that leaves the drilling apparatus again cannot be released directly into the ground. Rather, there is a need for pumping plants provided specifically therefor in order to remove the bentonite from the drill pit, and for special recycling plants for reuse, or for treatment plants in order subsequently to release the liquid thus cleaned into the environment. This method is therefore accompanied by enormous outlays on operation, costs, materials and time without thereby excluding environmental stress with certainty.

In addition, the bore heads used in rock drilling exhibit a tendency to jam in the rock. In such a case, the bentonite flows past the rotor and—without having effected rotation—flows from the motor into the earth in large quantities without being used.

In the case of the use of the customary viscose drive media, chiefly in the case of the use of bentonite, a further grave difficulty resides in their abrasive properties.

Consequently, all components coming into contact therewith must have a special surface, for example a ceramic coating. Nevertheless, it is still impossible thereby to avoid to a satisfactory extent a high rate of wear that necessarily drives the material costs up.

Once the pilot drill hole with the use of the mud motor has been concluded, the entire drive unit is usually detached, an enlarging bore head—a so-called hole opener—is mounted for enlarging the drill hole, and subsequently is set rotating by the rotation of the drill rod as a whole. Consequently, the drill rod as a whole must transmit the required high torque to the working tool, and this frequently leads to mechanical stresses and instances of buckling owing to the high stress from the reverse bending load and the abrasion on the exterior surfaces of the rod. All this also increases the wear, and thus the costs accruing.

At present, no use is being made, for underground drilling, of other motors usually operated with the aid of an oil-hydraulic system such as, for example, hydraulic gear motors, piston and radial piston motors or gear ring and hydraulic gear motors. The reason for this is, on the one hand, the widely held attitude that the motors, for the most part of expensive and complex configuration, for drilling in holes that are frequently difficult to access are not sufficiently robust and resistant when the nature of the ground changes greatly. On the other hand, for underground drilling these motors would need to be provided with expensive backflow lines for the hydraulic oil, since the oil cannot pass into the soil or certainly not be released into the soil. In addition to the feed and backflow lines for the hydraulic drive, there would also be a need for further lines and connections for the additionally required boring fluid. Even taking account of all the necessary care, it is impossible, nevertheless, to avoid contamination of the environment entirely in the case of a motor operated with the aid of an oleo-hydraulic system.

In the known prior art, no alternative drive medium is used in order to render these motors, actually driven hydraulically and with a high efficiency, useful nevertheless for underground drilling. Bentonite is not suitable as drive medium, since these motors have very narrow sealing gaps and lines which bentonite would very quickly block. Moreover, because of its abrasive properties, bentonite would quickly destroy seals and sensitive surfaces inside the motor. Both the costs for repair and maintenance, and the operational outlay would therefore be pushed up and render efficient drilling impossible.

The invention is therefore based on the problem of providing a cost-effective and environmentally friendly method and an apparatus with as high an efficiency as possible for drilling and enlarging holes, in particular for hard rock.

This problem is solved by means of the features of the independent claims. Advantageous developments are to be found in the subordinate claims.

The invention is based on the idea of driving the bore head for underground drilling and enlargement of holes in hard rock by means of a motor that, for its part, is set in motion by water as drive medium, and by not adding at least a portion of the additaments until downstream of the motor.

It is preferred to use an axial piston motor with water as drive medium. The water can be withdrawn for this purpose from any desired source, for example, a hydrant, a tank or a body of water located near the drill hole, and fed to a high-pressure pump. Depending on water quality, the water can pass a cleaning device on its way into the high-pressure pump. This is preferably implemented as a filter device that is arranged between the axial piston motor and high-pressure pump.

After the water in the high-pressure pump has been brought up to the desired operating pressure, it is fed to the drive. In a preferred embodiment, this can be performed directly via the drill rod; however, it is also possible to feed via an inner tube of a double-walled drill rod.

The use of water as drive medium for an axial piston motor offers a multiplicity of advantages: since it can be brought in from the immediate vicinity at virtually any location, expensive transportation costs and mileage costs are dispensed with. Furthermore, cost-intensive and time-consuming mixing apparatuses upstream of the inlet to the drive such as, for example, in the case of the use of bentonite, are no longer inevitably required. Above all, however, the water can be released into the soil after being used. No particular environmental stresses arise thereby, and so it is possible to dispense with treatment, cleaning or recycling plants. The overall costs of a drilling operation can thereby be substantially reduced.

In addition, all the components of the drilling apparatus that come into contact with the drive liquid are protected from premature wear by the use of water as drive liquid since, by contrast with bentonite, water has no abrasive properties.

However, should it be necessary to use a drive medium with a relatively high viscosity, a biologically degradable polymer can be added to the water. This solution can also be released into the environment directly without further environmental stress.

The axial piston motor that is preferably used works according to the principle of an "oblique plate" or "oblique axis", in the case of which an axial movement of the operating pistons caused by a flow of liquid can be converted into a rotary movement by an oblique plate or swash plate by virtue of the fact that the force of the pistons striking the rotatably mounted plate produces a torque that is transmitted to a driveshaft. The drilling tool is connected thereto.

A particular advantage in the use of an axial piston motor as drive for an underground drilling installation resides in its smaller spatial extent. This renders it substantially easier overall to manage the drilling apparatus as a whole.

Furthermore, these motors can withstand a substantially greater pressure difference, and so it is possible to work with an operating pressure of at present 160 bars, for example, that is higher by comparison with mud motors. As a direct advantageous consequence of this high energy density, the quantity of drive medium required for producing a high torque of the drilling tool is much reduced, and it is possible to achieve an extremely favorable efficiency. This can be up to 0.8. For the mud motor this is only 0.15.

Also advantageous is the possibility of interchanging the connections for the inlet and outlet of the drive medium. Specifically, when the exchange is made the direction of rotation of the motor, and thus also the direction of rotation of the drilling tool driven by it are reversed.

According to the invention, it is possible to couple to the axial piston motor a gear that, for its part, can drive the drilling tool mounted thereon. The use of two or more gears is also possible. These can also be arranged inside the drilling tool, for example in an enlarging tool (hole opener). After the finishing of the pilot drill hole, the drive unit is preferably not removed from the drill rod, but left thereon, for the purpose of further enlargement of the drill hole.

The use of at least one gear permits a further variation in the rotational speed and the torque. This is advantageous, in particular, upon conclusion of the pilot drill hole, since the enlargement phase following thereafter frequently requires a different torque and a different rotational speed than the pilot drill hole: whereas the drive for a pilot drill hole is frequently set to a high rotational speed in conjunction with a low torque, it is mostly a higher torque that is required during the enlargement.

Under particular circumstances, it can be necessary to feed a certain quantity of a special boring fluid, for example bentonite, to the drill hole in order to remove the drillings. This can be performed through an inlet for the boring fluid via an annular gap of a double-walled drill rod. In this case as well, the ecological, timing and financial advantages of the apparatus according to the invention and of the method are substantial, since the total quantity of bentonite required for the drilling is lower by far by comparison with the conventional method. In such a case, the consumption of bentonite can be approximately 10 to 30 l/min.

The invention will be explained in more detail below with reference to an exemplary embodiment illustrated in the drawing.

FIG. 1 is a partial cross-sectional view of the drilling apparatus embodying the present invention.

The drilling apparatus 1 comprises a drill rod 2 with a drive medium inlet 6 that, at its end on the head side, is connected to a housing 4 via a coupling piece 3. A boring fluid inlet 7 is arranged in the drill rod 2. This boring fluid inlet 7 opens in an exit opening 8 that is located in the coupling piece 3. A filter device 5 and an axial piston motor 9 with a driveshaft 12 are located in the housing 4. The axial piston motor 9 is connected to the drilling tool 11 via a gear 10.

The apparatus according to the invention and the method according to the invention are used as follows:

Firstly, the water is brought to the desired operating pressure via a high-pressure pump (not illustrated here). Subsequently, it is fed through the drive medium inlet 6 of the drill rod 2 to the filter device 5 in the housing 4. This water (then cleaned) further flows through the axial piston motor 9, which sets the drilling tool 11 rotating via the driveshaft 12 and gear 10. The water flows through the axial piston motor 9 and leaves the drilling apparatus 1 via exit openings (not illustrated) in the drilling tool 11.

The boring fluid for removing the drillings is fed to the drill hole via the boring fluid inlet 7 in the drill rod 2. It leaves the drill rod via the exit openings 8, which open in the connecting element 3.

What is claimed is:

1. A method for driving a motor for drilling or enlarging holes in soil or rock with the aid of a drive liquid, characterized in that water is used as drive medium in order to set moving the motor (9) for driving a drilling tool (11), and at least a portion of an additament is supplied downstream of the motor in the direction of flow to create a boring fluid for removing cut soil from the drill hole.

2. The method as claimed in claim 1, characterized in that a biologically degradable polymer is added to the water as additament.

3. The method as claimed in claim 1, characterized in that bentonite is used as additament.

4. The method as claimed in claim 1, characterized in that boring fluid is additionally fed to the drill hole in order to remove the drillings.

5. The method as claimed in claim 1 characterized in that the direction of rotation of the drilling tool (11) is reversed by changing the direction of flow of the drive medium through an axial piston motor (9).

6. An apparatus for drilling or enlarging holes in soil or rock comprising a drilling tool and an inlet (6) for a liquid medium, characterized by a water-operable axial piston motor (9) as a drive unit for the drilling tool (11), and by a supply appliance for additaments which is arranged downstream of the motor in the direction of flow.

7. The apparatus as claimed in claim 6, characterized in that the motor (9) drives the drilling tool (11) via a gear (10).

8. The apparatus as claimed in claim 6, characterized by a filter device (5).

9. The apparatus as claimed in claim 6, characterized in that the drive medium inlet (6) is provided in a drill rod (2).

10. The apparatus as claimed in claim 9, characterized in that the drive medium inlet (6) is formed from an inner tube located in the drill rod (2).

11. The apparatus as claimed in claim 6, characterized by a boring fluid inlet (7).

12. The apparatus as claimed in claim 11, characterized in that the boring fluid inlet (7) is designed as an annular gap of a double-walled drill rod (2).

* * * * *